United States Patent [19]

Fuchs et al.

[11] Patent Number: 4,846,201

[45] Date of Patent: Jul. 11, 1989

[54] APPLICATOR BOTTLE WITH METERING MEANS

[76] Inventors: Kathryn J. Fuchs, 5625 W. 97th St., Overland Park, Kans. 66207; Richard E. Davis, 1010 W. 56th St., Kansas City, Mo. 64113

[21] Appl. No.: 110,269

[22] Filed: Oct. 20, 1987

[51] Int. Cl.[4] ..... A46B 11/04

[52] U.S. Cl. ..... 132/212; 401/270; 401/287; 132/112

[58] Field of Search ..... 132/115, 108, 112, 148, 132/109, 110, 111, 88.7, DIG. 3, DIG. 4, 9; 401/270, 268, 287, 291

[56] References Cited

U.S. PATENT DOCUMENTS

| | | | |
|---|---|---|---|
| 98,257 | 12/1869 | Harris | 239/396 |
| D. 165,109 | 11/1951 | Petrosky | D4/114 |
| D. 186,350 | 10/1959 | Lerner et al. | D28/7 |
| D. 266,537 | 10/1982 | Kahn | D28/7 |
| D. 266,538 | 10/1982 | Kahn | D28/7 |
| D. 276,480 | 11/1984 | Nigro | D4/127 |
| D. 278,951 | 5/1985 | Kalinsky | D4/135 |
| 514,290 | 2/1894 | Symonds | 401/269 |
| 598,891 | 2/1898 | Barnekov | 73/427 |
| 663,245 | 12/1900 | Sturgis | 401/286 |
| 732,936 | 7/1903 | Graeme | 215/100 R |
| 1,084,974 | 1/1914 | Steine | 401/270 |
| 1,595,324 | 8/1926 | Van Sant | 401/28 |
| 1,928,929 | 12/1931 | Craig | 15/145 |
| 2,299,295 | 10/1942 | Battle | 132/120 |
| 2,617,431 | 11/1952 | Gaspari | 132/120 |
| 2,669,740 | 2/1954 | Main | 401/277 |
| 2,672,875 | 3/1954 | Kovacs | 132/112 |
| 2,770,826 | 11/1956 | Curfman | 401/139 |
| 2,785,426 | 3/1957 | Grey | 401/194 |
| 2,922,425 | 1/1960 | Lerner et al. | 132/9 |
| 2,944,273 | 7/1960 | Harris | 15/105 |
| 3,378,331 | 4/1968 | Beasley | 401/286 |
| 4,592,376 | 6/1986 | Sigmund et al. | 132/112 |
| 4,652,162 | 3/1987 | Ladd, Jr. et al. | 401/270 |

FOREIGN PATENT DOCUMENTS

| | | | |
|---|---|---|---|
| 0521993 | 6/1940 | United Kingdom | 401/291 |

*Primary Examiner*—Gene Mancene
*Assistant Examiner*—Adriene J. Lepiane
*Attorney, Agent, or Firm*—Banner, Birch, McKie & Beckett

[57] ABSTRACT

A squeeze-type applicator bottle has a cap provided with an opening in the top wall thereof through which solution is adapted to be dispensed and a mechanism for metering the flow of the solution through the opening comprising a disk having apertures aligned with the opening, the apertures being dimensioned to provide a preferred flow rate relative to the viscosity of the solution, the disk being adapted to be replaced by other disks having apertures designed to force solutoins of different viscosities whereby the applicator bottle can be used in substantially the same manner independently of the viscosity of the solution being dispensed.

3 Claims, 1 Drawing Sheet

APPLICATOR BOTTLE WITH METERING MEANS

BACKGROUND OF THE INVENTION

This invention relates to an applicator for dispensing solutions such as hair treating solutions and applying the solutions in a hair treating operation such as hair tinting, and particularly to means for metering the solutions from the applicator.

Containers are often provided with means for metering the flow of the contents as it's dispensed. Condiments, for example, may be provided with a cap having an opening that is opened or closed as the cap is turned to increase or decrease the effective size of the opening and thus to increase or decrease the rate at which the condiments are dispensed. Alternatively, the cap may have, for example, two holes of different sizes or shapes or two groups of holes that are the same size but different in number that are adapted to be aligned selectively with an opening in the container as the cap is turned thus increasing or decreasing the effective size of the opening. Products such as powders are usually sold in containers provided with caps having a plurality of holes through which the powders are shaken—the rate at which the powder is dispensed being determined by how coarse or fine the powder is relative to the size of the holes.

Another example of means for controlling the rate at which a product is dispensed by controlling the size of the openings through which it is dispensed is shown in the patent of Symonds, U.S. Pat. No. 514,290, which discloses a collapsible tube for glue in which a perforated diaphram is disposed in the mouth of the tube. The patent of Harris, U.S. Pat. No. 98,257, for example, discloses a hose nozzle in which a number of different disks may be used to control the flow of water from the nozzle to vary the stream.

Devices for dispensing hair treating solutions have also been provided with means for controlling flow. The patent of Battle, U.S. Pat. No. 2,299,295, shows a hair treating instrument having a reservoir for the treating solution that is dispensed through holes into a pad designed to prevent the solution from flowing freely through the holes and to cause it to seep into and saturate the pad. The patent of Main, U.S. Pat. No. 2,669,740, shows a dispenser having a flow controlling opening which is intended to be varied in size to suit the nature and viscosity of the liquid being dispensed. The patent of Kovacs, U.S. Pat. No. 2,672,875 shows a squeeze applicator in which the solution is adapted to be dispensed through calibrated openings in a selected diaphragm that is sized to accommodate the viscosity of the solution being dispensed.

Thus, various means are known for controlling the rate at which materials are dispensed through openings, and specifically for controlling the rate for dispensing hair treating solutions from a squeeze type container, including replaceable diaphragms. While there are recognized advantages in a dispenser of this type for dispensing hair treating solutions, they have found only limited use in practice. It is difficult to speculate on the reasons for this but it seems clear that the prior art devices have not provided sufficient advantage relative to their cost and ease of use to make them generally acceptable.

The objects of the present invention are to provide a squeeze-type applicator for materials such as hair-treating solutions having means for metering the flow of solution so that, regardless of the viscosity of the solution, the dispenser can be used in the same manner. Thus, after developing a technique or feel in the use of the dispenser, an operator need not vary that technique when switching from one solution to another. Additional objects of this invention are to provide such a dispenser that is inexpensive and easy to use.

SUMMARY OF THE INVENTION

In accordance with this invention, the dispenser is provided with a cap having an opening through which solution is adapted to be dispensed onto a brush means on the outer surface of the cap. The solution is metered through the opening by a disk that substantially conforms dimensionally to the inside of the cap and is adapted to be seated and releaseably held in the cap. The disk is provided with aperture means designed to meter a solution of a particular viscosity at a preferred rate, with finger means for grasping the disk seated in and to remove it from the cap and with retaining means for frictionally holding the disk in place in the cap. The disk is designed to be replaced by substitute disks with aperture means of different sizes for use with solutions of different viscosities.

DESCRIPTION OF THE PREFERRED EMBODIMENT

Figure 1:
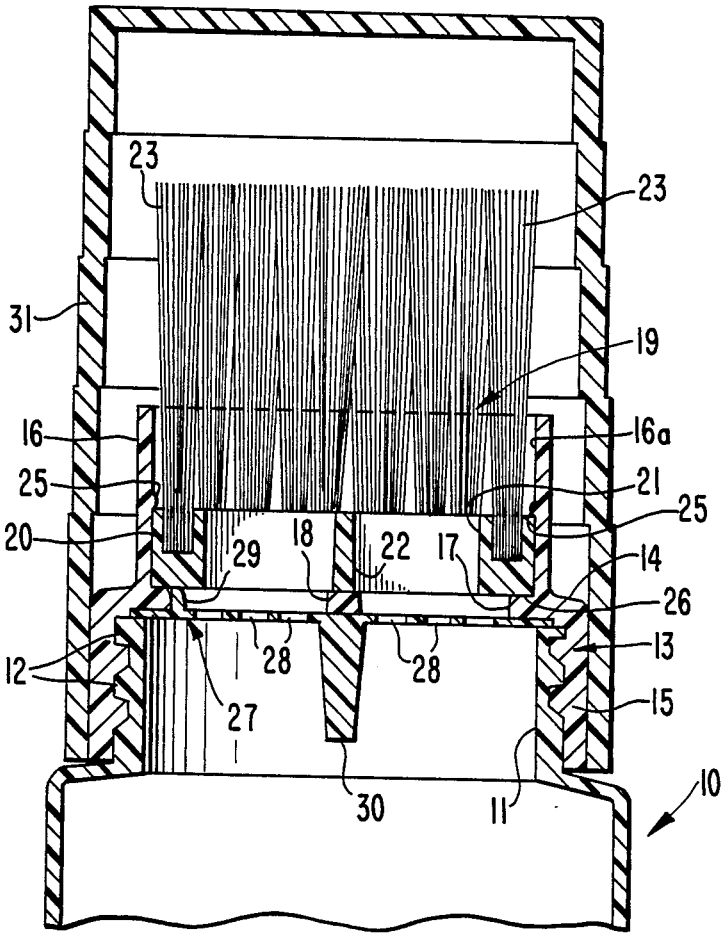
FIG. 1 is a fragmentary vertical sectional view transversely through the neck of an applicator having a cap made in accordance with this invention.
Figure 3:
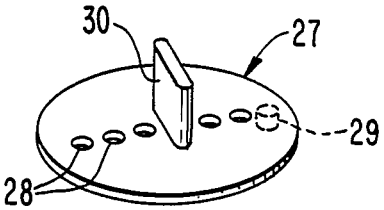
FIG. 3 is a perspective view of the bottom of the metering disk per se of the applicator bottle shown in FIG. 1.

The present invention is herein disclosed as embodied in the applicator bottle that forms the subject matter of the copending application of Fuchs et el, Ser. No. 944,000, filed June 2, 1987 and abandoned June 10, 1988. The applicator bottle comprises a squeeze-type bottle 10 for solutions such as hair treating solutions, the bottle being formed preferably of a deformable plastic material from which the solution can be forced by squeezing and thus deforming the bottle. Bottle 10 includes a reduced diameter neck 11 defining the mouth of the bottle and formed with an external thread 12 on which the cap 13 is adapted to be threaded for securing the cap on the neck 11 and thus closing the mouth of the bottle.

The cap 13 has a topwall 14 and a sidewall 15 depending from the periphery of the topwall 14 and in which an internal thread is formed that mates with the external thread 12 of the neck 11. An upstanding wall 16 rises from the topwall 14 of the cap 13 to define a well **16*a* on the topwall 14 of the cap surrounding and spaced substantially uniformly about a slot or an elongated opening 17 (FIG. 1) in the topwall 14, the well thus being elongated with rounded ends as seen in FIG. 2. The slot 17 may be provided with a stabilizing rib 18** extending transversely thereof at substantially the longitudinal midpoint.

A brush means 19 includes a plate 20 that is substantially planar and has an outline substantially conforming to the area of the topwall 14 within the wall 16 and adapted to be seated in the well 16*a* defined by wall 16. The plate 20 also an opening 21 corresponding to the opening or slot 17 in the topwall 14 and also has a stiffening rib 22 corresponding to the rib 18. The plate 20 has a thickness and width sufficient to receive the embedded ends of tufts of bristles 23 around the sides and ends of the opening 21. With the elongated configuration of the plate 20 and of the wall 16, the brush means 19 is automatically positioned in the well 16*a* with the opening 21 aligned with the opening 17.

Plate 20 is seated in the well 16a on a land 26 on the topwall 14 between the upstanding wall 16 and the opening 17 and is preferably retained therein by a rib 25 formed on the inside of the wall 16 at a distance up the wall from the land 26 that is only slightly greater than the thickness of the plate 20. The cap 13 is also preferably molded from a deformable plastic material whereby the plate 20 is adapted to be snapped or forced into the well 16*a* past the rib 25 and to be seated with the bottom edge thereof on the land 26 and the rib 25 overhanging the top edge thereof. The brush means 19 is thus held in position against the flow of solution that is squeezed from the bottle through the aligned openings 17 and 21 and can also be removed from the cap 13 by forcing the plate 20 upwardly past the rib 25. Thus the brush means 19 can be replaced when it becomes worn or damaged, or, if desired, a brush means having bristles of different lengths or density or stiffness can be substituted.

The well 16*a* defined by the upstanding wall 16 also functions to collect the solution draining from the bristles 23 when the bottle is not in use and returning it through the openings 21 and 17 to the bottle 10.

In accordance with this invention, there is provided a disk 27 having aperture means 28 that may as shown, comprise, for example, a series of holes although it could also of course be formed as a slit or a series of slits. The aperture means 28 acts to meter the solution from the bottle through the openings 17 and 21.

Disk 27 substantially conforms in outline to the inside of the cap 13 inside the internal threads so that the disk 27 can be seated on the underside of the topwall 14. When the cap 13 is threaded down on the neck 11, the disk 27 is clamped about the entire periphery thereof between the upper end of the neck 11 and the topwall 14 of the cap and thus confines the solution to movement through the aperture means 28.

When the cap 13 is separated from the bottle 10, the disk 27 is releaseably retained in the cap 13 by an upstanding finger 29 formed on the top of the disk at one end of the aperture means 28. The finger 29 is spaced from the opposite edge of the disk so that when it is seated in the end of the elongated opening 17 in the topwall 14, there is a force fit between the opposite edge of the disk 28 and inside of the sidewall 17 that holds the disk 27 frictionally in place. Being aligned with the aperture means 28, the finer 29 also serves to align the aperture means 28 with the openings 17 in the topwall 14.

Disk 27 also includes a fingerpiece 30 on the face opposite from the finger 29 at the center thereof, and is thus opposite the strengthening ribs 18 and 22 whereby the disk can be grasped for inserting it into the cap and for removing it from the cap.

Figure 4:
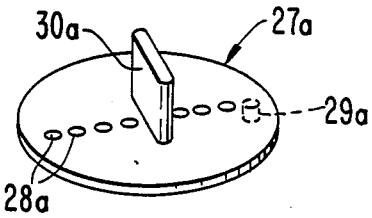
FIG. 4 is a perspective view similar to FIG. 3 of a substitute metering disk.

The disk 27 is designed to be one of a set of replaceable disks having aperture means of different size and/or a different number of holes or slits such as the disk 27*a* shown in FIG. 4 which includes a different number of apertures 28*a* of a different size. The disk 27*a* also includes a retaining finger 29*a* and a fingerpiece 30*a*. Disks, such as the disks 27 and 27*a*, are designed to control the flow of solution from the bottle and thus to permit the bottle to be used in substantially the same manner in successive operations despite different viscosities of the different solutions. The disk 27 can also be readily removed for cleaning and for cleaning the brush, which, with the disk removed, can be cleaned by water passing through the slots 17 and 21.

Figure 2:
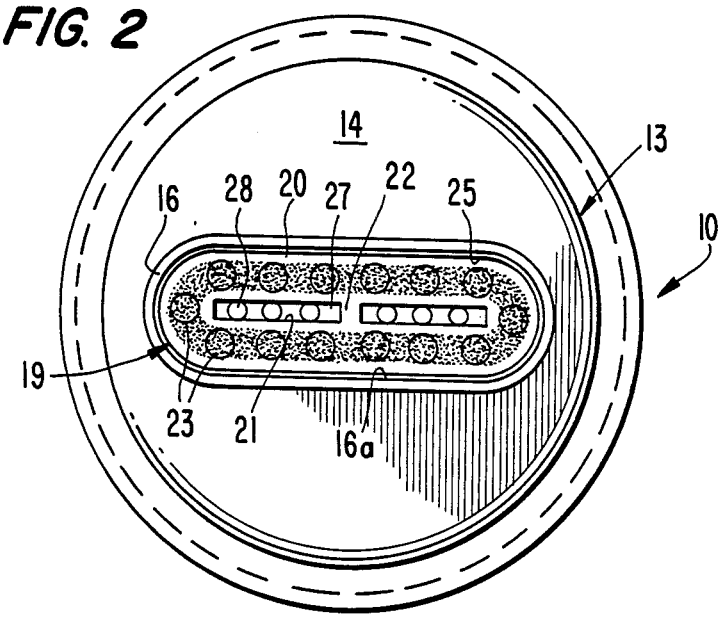
FIG. 2 is a top plan view of the applicator bottle of FIG. 1 with the brush cover removed.

As shown in FIG. 1, the bristles 23 are adapted to be covered by a cover member 31 when the bottle is not in use.

Various modifications of the device as herein disclosed, such as the device disclosed in the copending application of Fuchs et al, Ser. No. 944,000, filed Dec. 22, 1986, will be obvious to those skilled in the art.

We claim:

1. In a device for applying hair treating solution or the like comprising a squeeze-type container formed of a deformable material having a neck defining a mouth at one end and a cap comprising a topwall adapted to close said mouth and means associated with said topwall for securing said cap to said neck, said cap having brush means on the outer surface thereof and an opening through said topwall through which solution in said container is adapted to be dispensed onto said brush means, and means for metering solution through said opening comprising a disk substantially conforming in outline to the inside of said cap and adapted to be seated inside said cap on the underside of said topwall, said disk having aperture means adapted to communicate with the opening in said topwall when said disk is seated in said cap, means for releasably retaining said disk within said cap whereby said disk can remain in said cap when said cap is removed from said container and thereafter may be removed and a disk having different aperture means substituted therefore, thereby modifying the metering through said disk to accommodate solutions of different viscosities, and means on the underside of said disk to provide for grasping the disk for inserting the same into and for removing the same from said cap when said cap is removed from said container.

2. In a device in accordance with claim 1 in which said means on the underside of said disk to provide for grasping the disk for inserting the same into and for removing the same from said cap comprises a fingerpieces.

3. In a device for applying hair treating solution or the like comprising a squeeze-type container formed of a deformable material having a neck defining a mouth at one end and a cap comprising a topwall adapted to close said mouth and means associated with said topwall for securing said cap to said neck, said cap having brush means on the outer surface thereof and an opening through said topwall through which solution in said container is adapted to be dispensed onto said brush means, and means for metering solution through said opening comprising a disk substantially conforming in outline to the inside of said cap and adapted to be seated inside said cap on the underside of said topwall, said disk having aperture means adapted to communicate with the opening in said topwall when said disk is seated in said cap, means for releasably retaining said disk within said cap whereby said disk may be removed and a disk having different aperture means substituted therefore, thereby modifying the metering through said disk to accommodate solutions of different viscosities, said means for releaseably retaining said disk within said cap comprising a finger upstanding from said disk at the end of said aperture means, said finger being received within the opening in said cap at one end thereof to bias the opposite edge of the disk into a force fit engagement with the inside of said cap and to align said aperture means with said opening, and means on the underside of said disk to provide for grasping the disk for inserting the same into and for removing the same from said cap.

* * * * *